US005456639A

United States Patent [19]

Herbert et al.

[11] Patent Number: 5,456,639

[45] Date of Patent: Oct. 10, 1995

[54] SELECTIVELY STRESSED ENDLESS BELTS

[75] Inventors: William G. Herbert; David J. Hogle, both of Williamson; Steven J. Grammatica, Penfield; Peter J. Schmitt, Ontario, all of N.Y.; Ronald E. Jansen, Estes Park, Colo.; Mark S. Thomas, Williamson, N.Y.

[73] Assignee: Xerox Corporation, Stamford, Conn.

[21] Appl. No.: 197,904

[22] Filed: Feb. 17, 1994

Related U.S. Application Data

[62] Division of Ser. No. 801,997, Dec. 3, 1991.

[51] Int. Cl.[6] ..... F16G 5/00

[52] U.S. Cl. ..... 474/237; 474/260

[58] Field of Search ..... 474/237, 260, 474/270; 205/67, 76, 77; 355/200

[56] References Cited

U.S. PATENT DOCUMENTS

| | | |
|---|---|---|
| 3,963,587 | 6/1976 | Kreckel . |
| 4,501,646 | 2/1985 | Herbert . |
| 4,972,204 | 11/1990 | Sexton . |
| 5,131,893 | 7/1992 | Herbert . |
| 5,221,458 | 12/1990 | Herbert et al. . |

*Primary Examiner*—Michael Powell Buiz
*Attorney, Agent, or Firm*—Oliff & Berridge

[57] ABSTRACT

An endless metal belt resistant to failure due to stress induced by bending contains an internal stress gradient of radially outward increasing compressive stress which opposes external stress applied to the belt. The belt can be made by an electroforming process.

9 Claims, 3 Drawing Sheets

SELECTIVELY STRESSED ENDLESS BELTS

This is a division of application Ser. No. 07/801,997 filed Dec. 3, 1991.

This invention is directed to a method for strengthening endless belts against bending stress.

BACKGROUND OF THE INVENTION

Endless belts are commonly used for applications wherein they are subjected to high stress. In particular, endless metal belts which are used to transmit force in a pulley system such as a continuously-variable transmission (CVT) system or which repeatedly pass over any other sets of rollers such as in a belt-based photocopier are commonly exposed to a high degree of tensile stress and compressive stress. For example, when a belt is flexed, the outside surface of the belt is subjected to tensile stress, while the inside surface of the belt is subjected to compressive stress. Thus, there is a need to design a belt which is sufficiently strong to withstand these tensile and compressive stresses during operation of a system wherein a large number of flexures of the belt occur.

Failure of a member such as a belt occurs if one exceeds the tensile strength or the compressive strength of that member. In particular, a member may fail if the member breaks from a given stress (i.e., exceeding the ultimate tensile strength) such as, for example, 65,000 to 150,000 psi for a nickel belt. A member may also fail if it becomes permanently deformed (i.e., when the yield strength is exceeded). In an endless belt which is flexed, e.g., around rollers, at the point of maximum flexure the belt is subjected to both tensile stress and compressive stress, which leads to relatively rapid failure in a conventional belt. In particular, the radially outer surface of the belt is tensilely stressed, while the radially inner surface of the belt is compressively stressed. This is expressed by the following mathematical relationship:

$$S=(Y\times w)/r$$

wherein S is the stress at any point in the belt;

Y is Young's modulus for the belt material;

w is the radial distance from the neutral plane of operational stress (i.e., the radially central plane of the belt) to the point of the belt (i.e., one-half the thickness of the belt) to a point on the outer surface of the belt) where tensile stress is at a maximum; and r is the radius of the roller.

The value of w is positive moving radially outwardly from the neutral plane, leading to a positive (tensile) S; its value is negative moving radially inward from the neutral plane, leading to a negative (compressive) S.

To design a belt which is not prone to failure, it is necessary to keep the stress which develops in the belt (S) less than the yield stress which is known for that belt material. For example, the tensile yield stress of nickel may range from 50,000 to 85,000 psi. Therefore, the belt should have a maximum tensile stress of less than 50,000 psi in operation. However, the Young's modulus for nickel is 30,000,000, and thus to achieve a maximum tensile stress of, for example, 45,000 psi on the outer surface of a belt 0.003 inches thick, a roller with a 1 inch radius is required. This size roller is not advantageous for many of the intended uses of the belt of this invention. In a CVT application, for example, the belt may be required to carry an additional several thousand psi in use. Even in a copier, photoreceptor belts are typically tensilely stressed to about two thousand psi to insure that they run flat and grip the drive rollers, (e.g., a 0.001 inch thick belt which is 10 inches wide which is carrying a 50 pound load is under 5,000 psi tensile load before it is bent over a roller). These stresses are additive, thus causing one to use either thinner belts or bigger rollers. However, bigger rollers take up more space, weigh more and are more costly. Thinner belts are harder to handle without damage and are limited as to how much they can do. Thus, a method of forming a belt which can be used on a much smaller roller is desirable.

The use of a smaller roller is highly advantageous because it requires less material, weight and space, and thus lends itself to applications wherein miniaturization is desirable. A method of forming a thick belt for use on large radius rollers is also desirable, but such arrangements generally fail because of the large amount of tensile stress in the outer surface of a thick belt. Such a method is particularly useful in the design of photoreceptors which employ self stripping rollers. To self strip paper generally requires a 0.5 inch roller (0.25 radius); most paper will self strip off a 0.75 inch roller. Self-stripping is particularly useful because it eliminates stripper fingers which may cause premature failure of photoreceptors. However, this means that one is required to use belt photoreceptors which are very thin. One can just handle a 0.002 inch thick photoreceptor which is 3.3 inches in diameter, while 0.003 to 0.004 inches in thickness is required for a photoreceptor which is 10 inches in diameter.

U.S. Pat. No. 5,221,458 to Herbert et al. discloses an electroforming process for forming a multilayer endless metal belt assembly which includes forming increasingly compressively stressed successive belts on a mandrel, and assembling the belts to form a multilayer belt assembly. As the belts are removed from the mandrel, the compressive stress is relaxed, creating a precisely controlled gap between adjacent belts. The belt assembly so formed is particularly useful as a driving member for a continuously-variable transmission.

U.S. Pat. No. 4,501,646 to Herbert discloses an electroforming process for forming hollow articles having a small cross-sectional area. This patent discloses an electroformed belt having a thickness of at least about 30 Å and stress-strain hysteresis of at least about 0.00015 in./in., and wherein a tensile stress of between about 40,000 psi and about 80,000 psi is imparted to a previously cooled coating to permanently deform the coating and to render the length of the inner perimeter of the coating incapable of contracting to less than 0.04% greater than the length of the outer perimeter of the core mandrel after cooling. Any suitable metal capable of being deposited by electroforming and having a coefficient of expansion between about $6\times10^{-6}$ to $10\times10^{-6}$ in./in./°F. may be used in the process.

U.S. Pat. No. 3,963,587 to Kreckel discloses a method for electroforming relatively smooth seamless nickel, cobalt or nickel-cobalt alloy foil cylinders from an electrolyte for nickel or cobalt, the method comprising slowly increasing the current density from zero to its ultimate current density at the start up of the plating cycle.

U.S. Pat. No. 4,972,204 to Sexton discloses an orifice plate for use in ink jet printing which includes a first elongated lamina composed of electroformed metal or metal-alloy having a tensile or compressive stress condition and a second elongated lamina composed of metal or metal alloy electroformed onto the first lamina and having a counterbalancing stress condition. The electroformed plate has the following characteristics: 1) it operates effectively in longer array formats with planar wave stimulation; 2) it provides a plate construction with an increased thickness while maintaining a high flatness for the array surface; and 3) it has enhanced acoustic stiffness.

When an electroforming process is used to produce compressively stressed belts, they will generally have an inherent increasingly compressive stress gradient. Examples of such uncontrolled internal stress gradients are depicted as curves A and B in the graph shown in FIG. 1, based on a nickel electroforming bath and a chromium mandrel. Curve A depicts the stress gradient formed in a deposit on a normal chromium tank-finished mandrel. Curve B depicts the stress gradient formed in a deposit on a ground-finished mandrel. As shown by the manner in which both curves descend quickly, in electroformed compressive belts of the prior art, the initial deposit is tensilely stressed, but very quickly and uncontrollably becomes compressively stressed. Shortly after the deposit becomes compressively stressed, the internal stress levels off, and the degree of internal compressive stress over time remains fairly constant after the first few minutes.

SUMMARY OF THE INVENTION

It is an object of the invention to provide an endless belt which resists failure and is capable of being flexed many times over an extended period.

It is another object of the invention to provide a process for preparing an endless belt capable of being flexed many times over an extended period.

These and other objects are accomplished by an endless belt which contains an internal stress gradient which opposes external stress applied to the belt and provides the belt with operational stress-withstanding capability, and by a method of preparing such a metal belt by an electroforming process.

DETAILED DESCRIPTION OF PREFERRED EMBODIMENTS

This invention provides a process for fabricating electroformed endless belts, and the resultant belts which are suitable for use in applications which involve repeated flexing, such as electrostatographic imaging member components and continuously variable transmission (CVT) belts. A broad range of uses of an electroformed seamless metal belt is enabled by the process of this invention, which produces a strengthened belt less susceptible to failure because it contains an internal stress gradient which opposes external stress applied to the belt, thus reinforcing the belt's stress-withstanding capability. For example, the invention permits the use of relatively thick endless belts with relatively small rollers, which combination would otherwise be susceptible to rapid failure because of the large amount of tensile stress which occurs on the outer surface of the belts.

Figure 2:
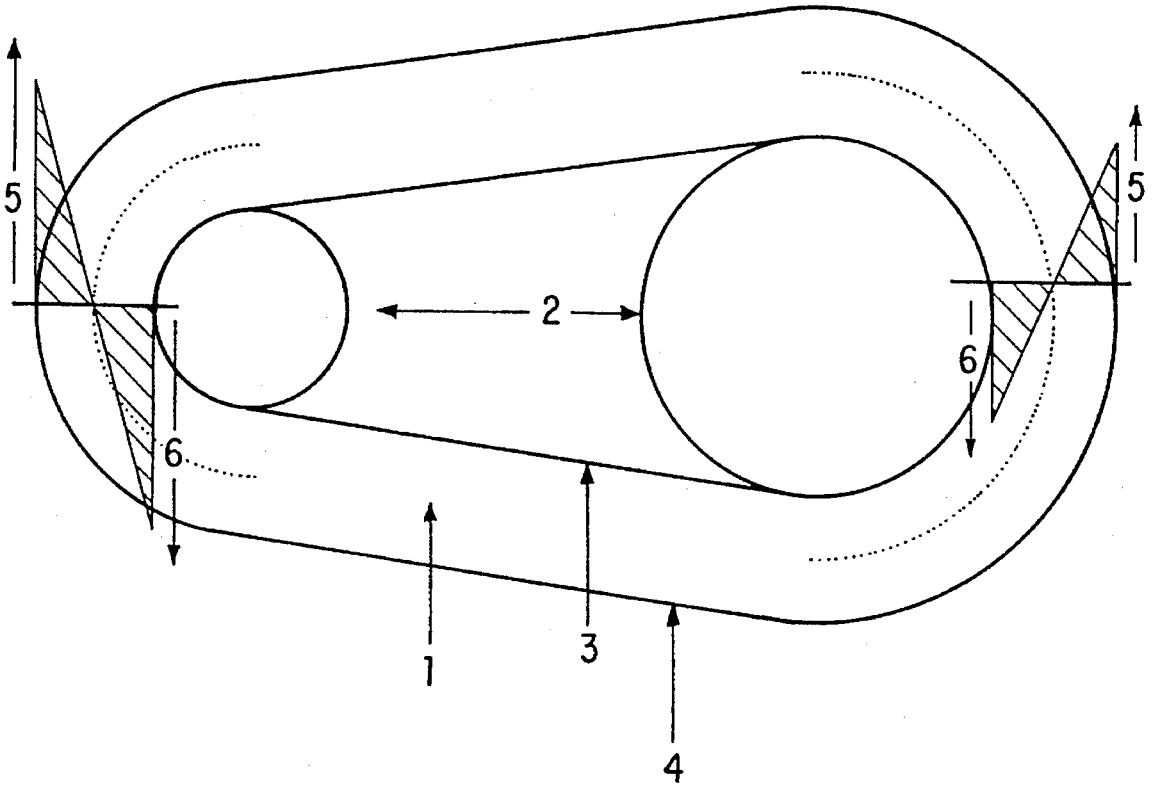
FIG. 2 depicts an endless belt during flexure.

FIG. 2 depicts a belt 1 in flexure around a roller 2, the belt having a radially inner surface 3 and a radially outer surface 4. The arrows indicate the direction of the bend induced stress on the radially outer surface, and arrows 6 indicate the direction of stress on the radially inner surface adjacent to the roller 2. The arrows 5 indicate that, when the belt is in operation, the radially outer surface is tensilely stressed, and arrows 6 indicate that the radially inner surface is compressively stressed.

If an outer surface of a belt is pre-stressed with internal compressive stress, the operational tensile stress on that surface will first merely neutralize the internal compressive stress before the application of additional operational tensile stress will cause the belt to fail. Conversely, if an inner surface of a belt is pre-stressed with internal tensile stress, the operational compressive stress on that surface will first merely neutralize the internal tensile stress before the application of additional operational compressive stress will cause the belt to fail. Thus, in the mathematical formula above, the invention factors in an additional stress component S' in the following manner:

$$S=((Y\times w)/r)+S'$$

wherein S' is the internal stress at the subject point in the belt. With the additional stress component factored into this relationship, the total stress on the belt is reduced, and thus the belt is less prone to failure.

The belt of this invention is provided with a controlled, preferably substantially constant, internal stress gradient during its preparation and prior to being exposed to external stress during use.

Tensile stress on an outer surface of an endless belt is more likely to generate belt failure than is compressive stress on an inner surface of the belt. Thus an important aspect of the invention is that the internal stress gradient extend to a high compressive stress at the outer surface of the belt. On the other hand, the internal stress on the inner surface of the belt is preferably tensile, but may be approximately zero or even somewhat compressive. Thus the internal stress gradient may start at the inner surface with a highly tensile to somewhat compressive stress (e.g., 150,000 to −20,000, for a nickel belt, depending on belt thickness and roll radius). The gradient extends to a substantially compressive internal stress at the outer surface. For example, an internal stress at the outer surface S' will reduce S to about 60% to 80% of the deposits' yield strength (i.e., the stress required to cause permanent deformation.)

For example, the 0.003 inch thick nickel belt described above with a yield strength of about 60,000 psi but with an internal stress gradient extending to an outer compressive stress of 90,000 psi (i.e., S'= −90,000 psi) permits use of a roller with a one-third inch radius $$[S = ((30{,}000{,}000 \times .0015)/.33) + (-90{,}000)$$
$$S \approx 45{,}000$$
$$45{,}000 \approx 60{,}000 \times 75\%]$$

Figure 3:
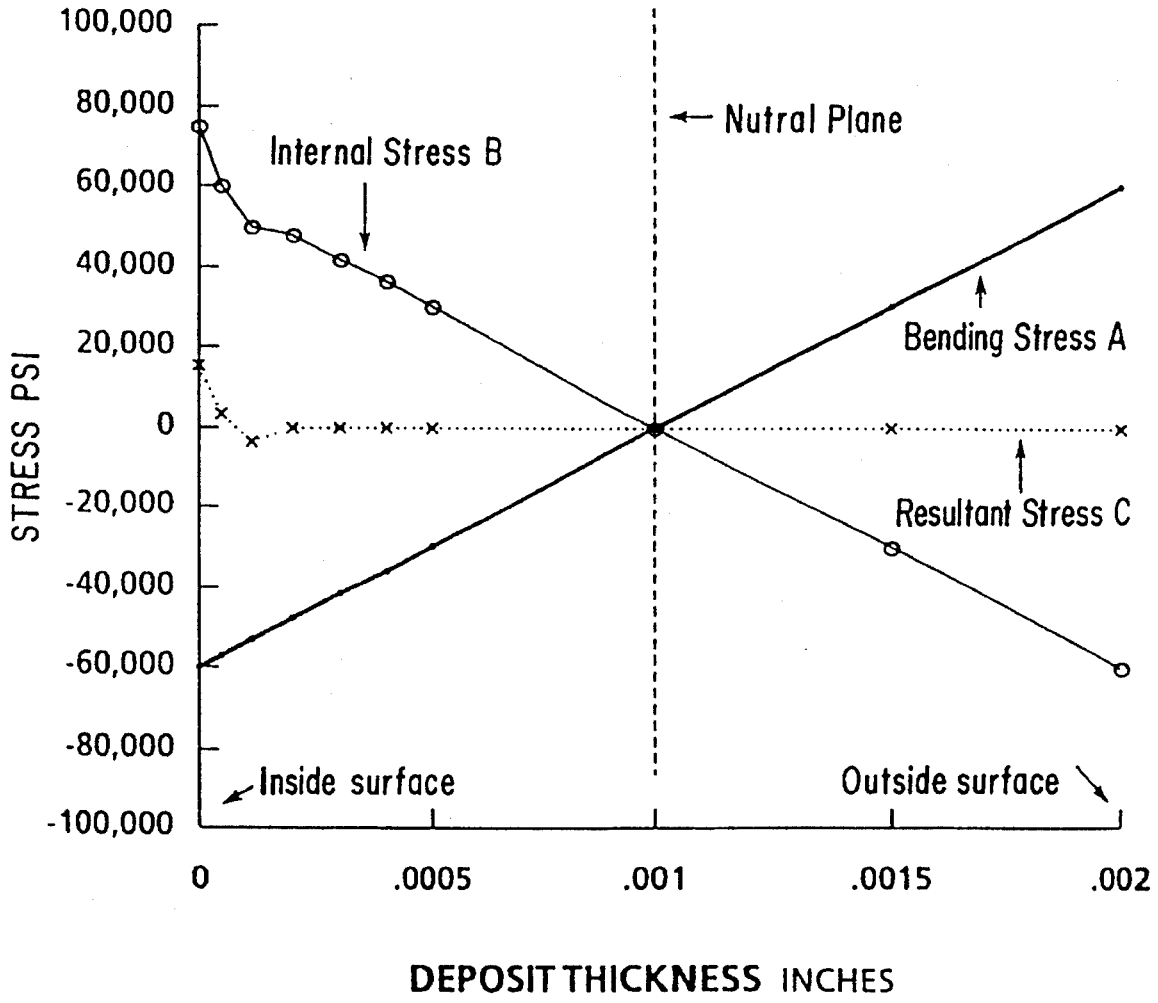
FIG. 3 is a graph showing the resultant stress formed by the interaction of internal stress and bend induced stress on a metal belt.

This gradient can be compared to the result of electroforming processes known in the art by comparing curve C with curves A and B of FIG. 3. According to the invention the curve is flattened to provide a controlled gradient in the deposit.

FIG. 3 provides a graph depicting the resultant stress formed by the interaction of internal stress and force applied to a metal belt. As the internal stress varies from tensile to compressive, and the bend-induced stress increases, the resultant stress remains relatively constant. This shows that the belt has stress-withstanding capability.

This invention thus provides a belt which, for example, is capable of flexing over a 0.5 inch radius rollers for more than twenty million flexes without cracking.

Such a belt is particularly useful in the operation of machines wherein small rollers are required to transmit force on objects during operation. For example, a belt of this invention may be used as a layer in a photoreceptor belt, wherein the belt comprises several layers including an optional substrate layer, a conductive layer, and at least one photosensitive layer, which belt is subjected to repeated flexing during operation. In a similar manner, a belt prepared according to the invention may be used with an ionographic imaging member, wherein the belt comprises an optional substrate layer, a conductive layer, and at least one dielectric/insulative layer. The substrate layer and/or conductive layer are particularly desirably formed from a belt of the invention. The belt can be flexed around very small rollers. In paper handling contexts, such as photoreceptor and/or ionographic imaging members, paper conveyors or the like, use of small rollers (e.g., with a diameter of 0.5 to 0.75 inch) with a belt of the invention permits easy separation of paper due to the inherent beam strength of paper. The belts of the invention are also useful for many other purposes. For example, they are useful as load carrying members (e.g., in a CVT).

A preferred method for preparing the belts of this invention is by an electroforming process similar to those disclosed in U.S. Pat. No. 3,844,906 to Bailey, U.S. Pat. No. 4,501,646 to Herbert, and U.S. Pat. No. 5,221,458. An electroforming bath is formulated to produce a thin, seamless metal belt by electrolytically depositing metal from the bath onto an electrolytically conductive core mandrel with an adhesive outer surface. While the process described below provides that the metal is deposited on the cathode, it is also possible for the metal to be deposited on the anode, and this invention may employ both arrangements. Generally, the metal belt of the invention is formed on a male mandrel. However, it is possible to use this process with a female mandrel as well, in which case the operating parameters are generally the opposite of those advantageous for use with the male mandrel (i.e., decreasing as opposed to increasing such parameters as temperature, rate of agitation, etc.).

The electroforming process of this invention permits very thin belts to be formed in a manner that permits different stress properties to be engendered in different portions of the belt material. An internal stress gradient is formed within the metal belt which is controlled and is preferably substantially constant, varying from a tensile stress or approximately zero stress to a somewhat compressive stress in the radially inner surface of the belt to a compressive, preferably highly compressive, stress in the radially outer surface of the belt. This is accomplished by selecting the electroforming bath materials and operating parameters of the electroforming process to produce an initial deposit which may have tensile stress, zero stress or compressive stress, depending on the mandrel used. The amount of internal stress produced in this initial deposit can be selected to offset the compressive stress to which the belt will be exposed during its intended use. After the desired thickness of the initial metal deposit has been achieved, the electroforming conditions may inherently alter or be altered such that further metal deposits on the previously deposited metal are, according to the desired gradient, increasingly compressively stressed. These alterations may be performed continuously or in steps, and both approaches may produce a "substantially constant" gradient as the latter term is used herein.

The electroforming process takes place within an electroforming zone comprised of an anode selected from a metal and alloys thereof, a cathode which is the core mandrel, and an electroforming bath comprising a salt solution of the metal or alloys thereof which constitutes the anode, and in which bath both the anode and cathode are immersed.

The electroforming process of this invention may be conducted in any suitable electroforming device. For example, a solid cylindrically shaped mandrel may be suspended vertically in an electroforming tank. The top edge of the mandrel may be masked off with a suitable, nonconductive material, such as wax, to prevent deposition. The mandrel may be of any suitable cross-section for the formation of an endless metal belt.

The electroforming tank is filled with the electroforming bath and the temperature of the bath is controlled. The electroforming tank may contain an annular shaped anode basket which surrounds the mandrel and which is filled with metal chips. The anode basket may be disposed in axial alignment with the mandrel. The mandrel may be connected to a rotatable drive shaft driven by a motor. The drive shaft and motor may be supported by suitable support members. Either the mandrel or the support for the electroforming tank may be vertically and horizontally movable to allow the mandrel to be moved into and out of the electroforming solution.

Electroforming current can be supplied to the tank from a suitable DC source. The positive end of the DC source can be connected to the anode basket and the negative end of the DC source connected to the drive shaft which supports and drives the mandrel. The electroforming current passes from the DC source connected to the anode basket, to the plating solution, the mandrel, the drive shaft, and back to the DC source.

The electroformed belt may be formed from any suitable metal capable of being deposited by electroforming and having a coefficient of expansion of between $6\times10^{-6}$ in./in./°F. and $10\times10^{-6}$ in./in./°F. Preferably the electroformed metal has a ductility of at least about 0.5% elongation. Typical metals that may be electroformed include nickel, copper, cobalt, iron, gold, silver, platinum, lead, and the like and alloys thereof. Preferably, the metal has a stress-strain hysteresis of at least about 0.00015 in./in. Nickel is especially preferred.

During the electroforming process, the mandrel is preferably rotated in such a manner that the electroforming bath is continuously agitated. Such movement continuously mixes the electroforming bath to ensure a uniform mixture, and passes the electroforming bath continuously over the mandrel.

The chemical composition and the physical characteristics of an electroformed metal belt are a result of the materials which form the electrolyte bath and the physical environment in which the belt is formed. Thus, the mandrel composition, bath chemistry (e.g., stress reducer concentration) and operating parameters of the electroforming reaction (e.g., bath temperature, agitation, and/or current density) may be controlled to produce a belt with the desired stress gradient.

The choice of the mandrel may be important to the process of the invention because the stress found in the initial deposit is produced only by the reaction of the electroforming materials to the mandrel, and not by the stress reducers or other chemical components of the electroforming bath. Thus control of the starting point of the stress gradient on the inner surface of the belt (with a male mandrel) is achieved by selection of the mandrel surface. For example, it is possible to produce completely compressively stressed belts by electroforming on a compressively stressed mandrel. It is also possible for a mandrel to be employed which will produce no tensile stress in the initial deposit. Metal belts which are initially tensilely stressed may be produced by using a mandrel which will impart tensile stress. This condition (high internal tensile stress) is thought to be due to the placement/misplacement of the metal atoms in a configuration which is foreign to them, whereby it is thought that the depositing metal atoms are trying to take up the lattice spacing of the mandrel metal atoms.

On a nickel mandrel, an initial nickel deposit will have a tensile stress ranging from 4,000 to 20,000 psi; if the nickel mandrel is polished, the tensile stress will be approximately 10,000 psi greater. On a ground finished chromium mandrel, a nickel deposit will have a tensile stress ranging from 80,000 to 120,000 psi. A tank-finished chromium mandrel will produce a tensile stress ranging from 40,000 to 60,000 psi. A polished stainless steel mandrel, however, will produce a tensile stress of less than 40,000 psi. Generally, the greater the mismatch between the lattice and grain parameters of the materials for the mandrel and the deposit (e.g., cubic versus hexagonal; lattice distances, etc.), the greater the amount of tensile stress formed. For example, a deposit made at 60° C., 300 amps per square foot (ASF), with rapid rotation from a standard nickel electroforming bath with up to 0.200 g/L sodium saccharin solution may often rip apart from the internal tensile stress if the deposit is made on thick finely ground chromium which is deposited on anodized aluminum. However, it will stay firmly together when the same deposit is made on thin tank-finished chromium which is deposited on nickel. Because most mandrel surfaces inherently impart a high initial tensile stress, there is a wide latitude in mandrel selection. Furthermore, where an extremely thin (i.e., atomic thickness) highly tensile layer is not problematic to a product belt, this initial layer may be ignored with the stress gradient being controlled by bath chemistry and operating parameters throughout the remainder of the belt.

To consistently produce nondefective deposits on a finely ground finished chromium surfaced mandrel (e.g., a mandrel which can cause a nickel deposit to have a stress on the order of 120,000 psi tensile) the mandrel surface must be scrubbed before deposition. This treatment improves the adhesion of the deposit to the mandrel sufficiently to overcome the stresses involved.

When using a 304 stainless mandrel in a bath which contains halogen ions, improved parting and less variability in the starting stress can be realized by first drying the mandrel before it is introduced into the electrolyte. The drying facilitates the formation of the natural oxide layer.

The core mandrel is preferably solid and of large mass to prevent cooling of the mandrel while the deposited coating is cooled. In such an embodiment, the mandrel should have high heat capacity, preferably in the range from about 3 to about 4 times the specific heat of the electroformed article material. This determines the relative amount of heat energy contained in the electroformed article compared to that in the core mandrel.

Typical mandrel materials may include stainless steel, iron plated with chromium or nickel, nickel, titanium, aluminum plated with chromium or nickel, titanium-palladium alloys, nickel-copper alloys such as Inconel 600 and Invar (available from Inco), and the like. The outer surface of the mandrel should be passive, i.e., adhesive, relative to the metal that is electrodeposited to prevent adhesion during electroforming. The cross-section of the mandrel may be of any suitable shape, and is preferably circular. The surface of the mandrel should be substantially parallel to the axis of the mandrel.

Further, the core mandrel in such an embodiment should exhibit low thermal conductivity to maximize the difference in temperature between the electroformed article and the core mandrel during rapid cooling of the electroformed article to prevent any significant cooling and contraction of the core mandrel. In addition, a large difference in temperature between the temperature of any cooling bath used during the removal process and the temperature of the coating and mandrel maximizes the permanent deformation due to the stress-strain hysteresis effect.

The electroforming bath is a medium wherein complex interactions between such elements as the temperature, electroforming metal ion concentration, agitation, current density, density of the solution, cell geometry, conductivity, rate of flow and specific heat occur when forming the metal belt. Many of these elements are also affected by the pH of the bath and the concentrations of such components as buffering agents, anode depolarizers, stress reducers, surface tension agents, and impurities.

The initial electroforming bath includes metal ions (the concentration of which may range from trace to saturation, and which ions may be in the form of anions or cations); a solvent; a buffering agent, (the concentration of which may range from 0 to saturation); an anode depolarizing agent (the concentration of which may range from 0 to saturation); and, optionally, grain refiners, levelers, catalysts, stress reducers, and surfactants.

The maximum diameter of the deposit will be limited by the adhesion of the deposit to the mandrel and the stability of the electrolyte at elevated temperatures. Sulfamate will start to break down at about 150° F.; consequently, one would limit the amount of time that the electrolyte was kept at temperatures at or above 150° F. If the internal stress becomes too compressive, the stress will be relieved during deposition, resulting in a buckled deposit. Alternatively, if the internal stress becomes too tensile, the deposit will pull apart causing fissures within the deposit.

For very thin belts, the desired gradient may be achieved without changing deposition conditions by selection of a mandrel which will produce the desired inner tensile stress and bath chemistry and operating parameters which will produce the desired outer compressive stress. However, for most practical purposes, it is necessary to modify both chemistry and/or operating parameters to achieve the desired gradient of the invention.

The control of many of the elements of the electroforming bath, including the concentration of impurities and the operating parameters, can be achieved by methods known in the art. For example, control of the pH by means of buffering agents, and preferred parameters for electrical current, time, and cell geometry are within the knowledge of those skilled in the electroforming art, and may have negligible impact on the incorporation of the stress gradient in the electroformed belt. Other more critical components are discussed and exemplified below, and include temperature, bath chemistry, rate of agitation and current density.

The temperature of the electroforming bath can be adjusted to control stress increased temperature increases the mobility of the constituents in an electrolyte and decreases the thickness of the diffusion layers. Thus, the ability of many constituents to reach the cathode is facilitated. An increase in temperature of the bath of as little as 0.5° F. may result in a significant increase in the compressive stress of a belt formed.

The internal stress of a metal deposit such as nickel can be influenced by electrolyte addition agents such as sodium benzosulfimide dihydrate (saccharin) and 2-methyl benzene sulfonamide (MBSA) tensile stress reducers as well as many other chemicals which are in the electrolyte as impurities (e.g., zinc, tin, lead, cobalt, iron, manganese, magnesium, etc.) or in the electrolyte because of the breakdown of one or more of the constituents. Azodisulfonate, sulfite, and ammonium are examples of the latter. Thus a controlled increase in the concentration of tensile stress reducers (either by adding them to the bath from an external source or by producing them in situ) can be used to produce the control stress gradient of the invention. Some electrolyte constituents, whether they are added (e.g., boric acid), are impurities (e.g., sodium, copper), or are breakdown products (sulfate), have little or no direct impact on the internal stress of the deposit at concentrations which are near those normally found in working electrolyte baths. The concentration of tensile stress reducers may be increased while deposition is occurring to provide the desired stress profile but this will necessitate the removal of these agents before the bath can be reused to make a similar part. The removal of tensile stress reducers is arduous, e.g., the removal of MBSA and saccharin requires carbon treatment. The preferred method for controlling the stress profile using tensile stress reducers is to increase their mobility and/or decrease the distance they must travel via increasing bath temperature or increasing agitation, respectively.

Because of the significant effects of both temperature and solution composition on the final product, it is very desirable to maintain the electroforming solution in a continuous state of agitation, thereby substantially precluding localized hot or cold spots, stratification and inhomogeneity in the composition. Moreover, agitation continuously exposes the mandrel to fresh solution and, in so doing, reduces the thickness of the cathode film, thus increasing the rate of diffusion through the film and thus enhancing metal deposition. Agitation may be maintained by continuous rotation of the mandrel and/or by impingement of the solution on the mandrel and cell walls as the solution is circulated through the system. Generally, the solution flow rate can range from 0 to about 75 L/minute across the mandrel surface and the rotation of the mandrel can range from about 1 rpm to about 2500 rpm. The combined effect of mandrel rotation and solution impingement assures uniformity of composition and temperature of the electroforming solution within the electroforming cell. An increase in the amount of agitation can produce an increase in the compressive stress of the formed belt.

Different degrees of tensile and/or compressive stress can also be produced in the metal deposit by adjusting the current density. The current density may range from about 10 to about 1200 ASF. Increasing the current density can increase the IR drop between the anode and cathode, which can cause the steady state temperature of the electrolyte to increase. The effect of temperature was discussed above. The temperature can also be controlled by adjusting other parameters appropriately. For example, the flow rate and/or the temperature of electrolyte to the cell could be adjusted to compensate for changes in IR. Electrolyte conductivity and/or specific heat could also be adjusted to keep the temperature constant while changing the current density. These adjustments can also impact the internal stress of the deposit.

For example, the amount of metal such as nickel deposited per unit time is directly proportional to the cathode efficiency and the current density. At 100% cathode efficiency, constant agitation and constant temperature, the deposition rate of nickel will double if the cathode current density is doubled. However, the deposition rate of tensile stress reducers will not increase. This is particularly the case with constituents like sodium benzosulfimide dihydrate. Thus, decreasing current density under such conditions will cause the compressive stress in the deposit to increase.

When the belt formed of deposited metal has reached the desired thickness and degree of compressive stress, it may be removed from the mandrel. When the electroforming of a belt is complete and the belt is to be removed from the mandrel, the mandrel is removed from the electroplating tank and immersed in a cold water bath. The temperature of the cold water bath is preferably between about 80° F. and about 33° F. When the mandrel is immersed in the cold water bath, the deposited metal belt is cooled prior to any significant cooling and contracting of the solid mandrel to impart an internal stress of between about 40,000 psi and about 80,000 psi to the deposited metal. If the metal is selected to have a stress-strain hysteresis of at least about 0.00015 in./in., it is permanently deformed, so that after the core mandrel is cooled and contracted, the deposited metal belt may be removed from the mandrel. The belt so formed does not adhere to the mandrel since the mandrel is formed from a passive material. Consequently, as the mandrel shrinks after permanent deformation of the deposited metal, the belt may be readily slipped off the mandrel. The belt must be bigger than the mandrel (assuming that the mandrel is not tapered) if one is going to remove the part from the outside of the mandrel. This can be facilitated by using a mandrel which is chiefly fabricated of a material which has a linear coefficient of thermal expansion which is larger or smaller than the linear coefficient of thermal expansion of the belt. For example, in cross section (from inside out), such a mandrel may be 1 inch of aluminum, 0.001 inch of nickel, and 0.001 inch of chromium. Aluminum has a linear coefficient of thermal expansion of about $13\times10^{-6}$ in./in./°F. and nickel has a linear coefficient of thermal expansion of about $8\times10^{-6}$ in./in./°F. To separate a belt made on a mandrel with a linear coefficient of thermal expansion which is less than that of the belt, the belt and the mandrel are heated to obtain a parting gap.

This relationship can be expressed in the following manner:

$$\text{PARTING GAP}=T(\alpha_M-\alpha_d)D$$

wherein T is the difference between the parting temperature and the deposition temperature, $\alpha_M$ is the linear coefficient of thermal expansion of the mandrel, $\alpha_d$ is the linear coefficient of thermal expansion of the deposit, and D is the outside diameter of the mandrel at the deposition temperature.

The invention will further be illustrated in the following non-limitative example, it being understood that this example is intended to be illustrative only and that the invention is not intended to be limited to the materials, conditions, process parameters and the like recited herein.

EXAMPLES

Comparative Example

Figure 1:
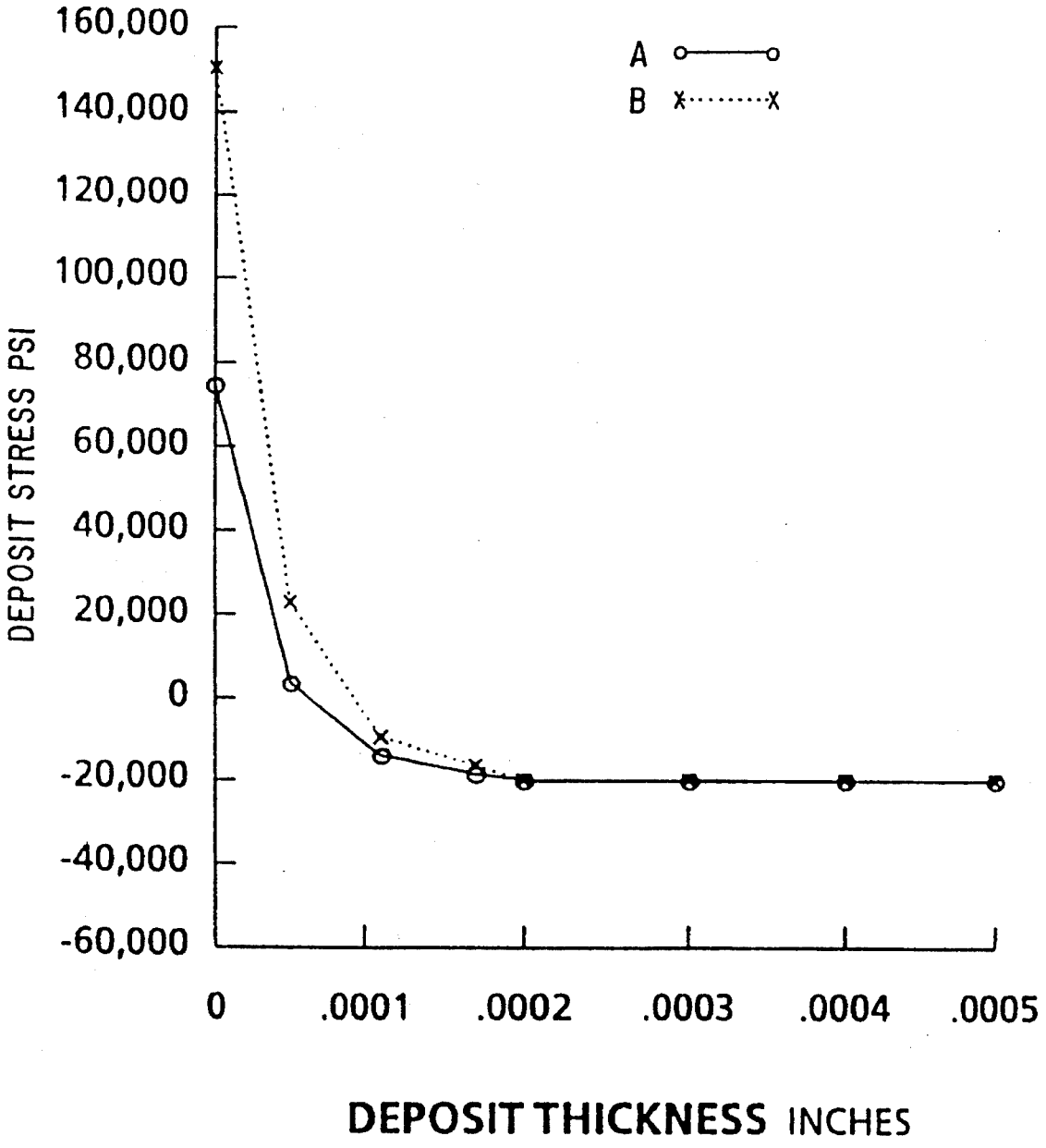
FIG. 1 is a graph showing stress gradients in electroformed endless belts over electroformed thickness.

Nickel is electrodeposited on a mandrel comprising thin tank finished chromium deposited on nickel. The nickel is deposited at 60° C. and 300 ASF with rapid agitation from a standard nickel electroforming bath containing 0.150 g/L sodium saccharin. The initial deposit is highly tensilely stressed. After about 20 seconds, approximately 0.000083 inches of nickel are deposited, and the deposit starts to become internally compressive stressed. This stress reaches a steady state at about 20,000 psi compressive stress in about one minute or at about 0.00025 inches. See FIG. 1. The metal deposit forms a composite which resists compressive failure on the inside radius by virtue of being tensilely stressed in that portion and resists failure on the outside radius by being compressively stressed in that portion of the composite. However, the deposit is too thin for many applications.

Example 1

Nickel is electrodeposited on a mandrel comprising thin tank finished chromium deposited on aluminum. The nickel is deposited at 60° C. and 700 ASF with rapid agitation from a standard nickel electroforming bath containing 0.300 g/L sodium saccharin. The initial deposit is highly tensilely stressed. The current density is reduced at a rate of 100 ASF per minute. After about 6 minutes, approximately 0.002 inches of nickel are deposited, and the deposit has the internal stress profile shown in FIG. 3.

Example 2

Nickel is electrodeposited on a mandrel comprising polished stainless steel. The nickel is deposited at 50° C. and 250 ASF with rapid agitation from a standard nickel electroforming bath containing 0.200 g/L MBSA. The initial deposit is highly tensilely stressed. The temperature is increased at a rate of 1° C. per minute. After about 10 minutes, approximately 0.0021 inches of nickel are deposited, and the deposit has an internal stress profile which gradually changes from about 35,000 psi tensile to about 38,000 psi compressive at its surface.

Example 3

Nickel is electrodeposited on a mandrel comprising thick ground finished chromium on aluminum. The nickel is deposited at 55° C. and 600 ASF with rapid agitation from a standard nickel electroforming bath containing 0.250 g/L MBSA. The initial deposit is highly tensilely stressed. The temperature is increased at a rate of 0.5° C. per minute while the current density is decreased by 50 ASF per minute. After about 10 minutes, approximately 0.003 inches of nickel are deposited, and the deposit has an internal stress profile which gradually changes from about 120,000 psi tensile to about 100,000 psi compressive at its surface.

Although the invention has been described with reference to specific preferred embodiments, it is not intended to be limited thereto. Those skilled in the art will recognize that variations and modifications can be made therein which are within the spirit of the invention and within the scope of the claims.

What is claimed is:

1. An endless metal belt comprising a radially inner surface and a radially outer surface, said radially inner surface and said radially outer surface each having an internal stress value and said belt having a substantially constant increasing internal stress gradient from said internal stress value at said radially inner surface to said internal stress value at said radially outer surface.

2. The metal belt of claim 1, wherein said internal stress value at said radially inner surface is −10,000–160,000 psi.

3. The metal belt of claim 1, wherein said internal stress value on said radially inner surface is tensile and said internal stress value on said radially outer surface is compressive.

4. The metal belt of claim 1, wherein said internal stress value on said radially inner surface is approximately 0.

5. The metal belt of claim 1, wherein said internal stress value on said radially outer surface is −120,000—60,000 psi.

6. The metal belt of claim 1, formed by an electroforming process.

7. The metal belt of claim 6, wherein said belt is a continuously variable transmission belt.

8. A photoreceptor belt comprising a conductive layer, a substrate layer, and at least one photosensitive layer, wherein at least one of said conductive layer and said substrate layer is an electroformed layer comprising a radially inner surface and a radially outer surface, said radially inner surface and said radially outer surface each having an internal stress value and said electroformed layer having a substantially constant increasing internal stress gradient from said internal stress value at said radially inner surface to said internal stress value at said radially outer surface.

9. An ionographic imaging member comprising an optional substrate layer, a conductive layer, and a dielectric layer/insulative layer, wherein at least one of said substrate layer and said conductive layer comprises a radially inner surface and a radially outer surface, said radially inner surface and said radially outer surface each having an internal stress value and said at least one of said substrate layer and said conductive layer having a substantially constant increasing internal stress gradient from said internal stress value at said radially inner surface to said internal stress value at said radially outer surface.

* * * * *